US006550390B2

(12) United States Patent
Frankenberger

(10) Patent No.: US 6,550,390 B2
(45) Date of Patent: Apr. 22, 2003

(54) METHOD AND DEVICE FOR RELEASING PRINTING MATERIAL FROM A CYLINDER

(75) Inventor: Eckart Frankenberger, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/878,898

(22) Filed: Jun. 11, 2001

(65) Prior Publication Data

US 2001/0050018 A1 Dec. 13, 2001

(30) Foreign Application Priority Data

Jun. 9, 2000 (DE) ..... 100 28 667

(51) Int. Cl.[7] ..... B41F 1/54
(52) U.S. Cl. ..... 101/483; 101/211
(58) Field of Search ..... 101/483, 17, 32, 101/34, 129, 170, 211, 409; 8/467; 204/2; 264/132

(56) References Cited

U.S. PATENT DOCUMENTS 5,884,561 A * 3/1999 Thunker et al. ..... 101/409

FOREIGN PATENT DOCUMENTS

| | | |
|---|---|---|
| DE | 104 753 | 3/1974 |
| DE | 33 44 424 A1 | 6/1985 |
| DE | 19613963 A1 | 10/1997 |
| DE | 19943029 A1 | 4/2000 |

OTHER PUBLICATIONS

USPTO Official Translation of DE 104 753.*

McGraw–Hill Dictionary of Scientific and Technical Terms, p. 2154, definition of "wave", published 1994.*

* cited by examiner

*Primary Examiner*—Andrew H. Hirshfeld
*Assistant Examiner*—Charles H. Nolan, Jr.
(74) *Attorney, Agent, or Firm*—Laurence A. Greenberg; Werner H. Stemer; Gregory L. Mayback

(57) ABSTRACT

A method for releasing printing material from a cylinder in a device for processing the printing material includes directing waves into a wedge-shaped space located between the printing material and the cylinder; and a device for performing the method.

15 Claims, 1 Drawing Sheet

METHOD AND DEVICE FOR RELEASING PRINTING MATERIAL FROM A CYLINDER

BACKGROUND OF THE INVENTION

1. Field of the Invention

The invention relates to a method and a device for releasing or loosening printing material from a cylinder, more particularly, in a device for processing the material.

The former German Democratic Republic Patent (DD-PS) 104 753 teaches a device wherein compressed air with approximately two atmospheres excess pressure is blown into a wedge-shaped space between a rubber blanket cylinder and a sheet of printing material in order to keep a so-called tear angle at the sheet constant.

Due to the aforementioned high air pressure, which is equal to approximately ten times the air pressure that is typical for blowing or blast devices for sheet guidance in sheet-fed rotary printing presses, the compressed air consumption is very high in spite of a controlled feeding of compressed air, and the operation is associated with disturbing noise. Additional prior art is described in the published German Patent Document DE 196 13 963 A1.

2. Summary of the Invention

It is accordingly an object of the invention to provide a method and a device for releasing or loosening printing material from a cylinder with which there is no noise disturbance, and the energy consumption is low.

With the foregoing and other objects in view, there is provided, in accordance with one aspect of the invention, a method for releasing printing material from a cylinder in a device for processing the printing material, which comprises directing waves into a wedge-shaped space located between the printing material and the cylinder.

In accordance with another mode, the method of the invention includes directing the waves at tear threads adhering to the cylinder and the printing material.

In accordance with a further mode, the method of the invention includes focusing the waves.

In accordance with an added mode, the method of the invention includes providing the waves in the form of ultrasonic waves.

In accordance with an additional mode of the method invention, the ultrasonic waves have a frequency of approximately 50 kilohertz.

In accordance with yet another mode, the method of the invention includes providing the waves as electromagnetic waves.

In accordance with yet a further mode of the method invention, the electromagnetic waves are microwaves.

In accordance with yet an added mode of the method invention, the electromagnetic waves are light waves.

In accordance with another aspect of the invention, there is provided a device for releasing printing material from a cylinder in a device for processing the printing material, comprising at least one wave source directed at a wedge-shaped space located between the printing material and the cylinder.

In accordance with another feature of the releasing device of the invention, the wave source is an ultrasonic source.

In accordance with a further feature of the releasing device of the invention, the ultrasonic source has a piezoelectric construction.

In accordance with an added feature of the releasing device of the invention, the wave source is disposed near a printing nip defined by the cylinder.

In accordance with an additional feature of the invention, the releasing device includes a plurality of the wave sources directed at the focus.

In accordance with yet another feature of the releasing device of the invention, the wave sources directed at the focus are angularly offset from one another in a vertical plane.

In accordance with yet an added feature of the releasing device of the invention, the wave source is a light source.

In accordance with yet another feature of the releasing device of the invention, the light source is a halogen tube.

In accordance with a concomitant feature of the releasing device of the invention, the wave source is a heat emitter.

Thus, the method of the invention for removing printing material from a cylinder in a device for processing the printing material calls for waves to be directed into a wedge-shaped space between the printing material and the cylinder.

In a development completely eliminating noise, the waves are ultrasonic waves. Because the frequency of the ultrasonic waves is above 20 kHz and is thus outside the range of human hearing, disturbing noise is out of the question.

In a development that is advantageous with respect to avoiding disturbances in a fluid residue film that remains on the cylinder after a transfer of fluid, such as ink or varnish, from the cylinder to the printing material, a central beam of the waves and ultrasonic waves, respectively, is directed directly onto pasty or gooey liquid threads stretching from the printing material to the cylinder, the fluid residue film on the cylinder remaining virtually untouched by the ultrasonic waves.

In a development that is advantageous with respect to achieving a high energy density in the region of a tear line of the printing material, central beams of the waves and ultrasonic waves, respectively, which are emitted from different directions intersect at a point that lies in the region of the tear line.

In a development that is advantageous with respect to reducing the adhesive power (tack value) of the pasty liquid with particular effectiveness by the influence of the ultrasonic waves on the fluid, the frequency of the ultrasonic waves is over 30 khz and preferably over 40 khz. When the fluid is a conventional offset ink, a frequency of approximately 50 khz is preferable.

Instead of the ultrasonic waves, electromagnetic waves such as light waves or microwaves may be directed into the wedge-shaped space between the printing material and the cylinder.

With the aforementioned electromagnetic waves, which also can be focused, a local heating of the ink can be effected in the region of the tear line.

The device according to the invention for removing or releasing printing material from a cylinder in a device for processing the material has at least one wave source that is directed into a wedge-shaped space disposed between the printing material and the cylinder.

This device for performing the method of the invention consumes relatively little energy in order to excite the at least one wave source, compared to using a blow or blast bar (note the aforementioned German Democratic Republic Patent 104 753) or the like for removing or releasing purposes.

Advantageously, the at least one wave source is constructed as at least one ultrasonic source.

In a development that is advantageous in view of the small structural size of the device, the ultrasonic source or sources are constructed as piezo-elements. The at least one ultrasonic source can thus be installed in the device relatively deeply in the wedge-shaped space and close to the tear line.

In a development that is advantageous with respect to the realization of the device for processing the printing material as a printing machine and the realization of the cylinder as a rubber blanket cylinder or varnishing cylinder thereof, the source or sources of the waves and ultrasonic waves, respectively, are disposed close by a printing nip defined by the aforementioned cylinder and an impression cylinder.

It is also conceivable, however, to realize the device for processing the printing material as a coating machine and to realize the cylinder as an application cylinder. For example, the cylinder, functioning as an application cylinder, can be provided in the coating machine for applying an adhesive and glue layer, respectively, to the printing material.

In a development that is advantageous in view of the concentrated use of a plurality of ultrasonic sources, central beams of the wave and ultrasonic sources, respectively, are directed at one and the same focus, which is formed by the liquid threads and situated at the tear line.

Focusing of the ultrasonic waves can also be accomplished by using a so-called ultrasonic lens, which is constructed as a part that is bent shell-like around a focus and that oscillates with a frequency corresponding to the ultrasonic, and which casts all ultrasonic waves onto the focus in the region of the liquid threads.

In a development that is advantageous with respect to determining the position of a horizontal tear line, the ultrasonic sources are inclined upwardly and/or downwardly relative to one another so that the central beams of the ultrasonic waves, which emanate from the ultrasonic sources, meet in the focus.

The wave sources can also be realized as light or heat emitters, e.g., as halogen tubes.

The device for processing the printing material is preferably a printing machine for printing by an indirect printing method, which includes a printing form cylinder and an impression cylinder guiding the printing material. In this case, the cylinder from which the printing material is released or removed is disposed between the printing form cylinder and the impression cylinder and is formed as a rubber blanket cylinder for ink transfer.

Other features which are considered as characteristic for the invention are set forth in the appended claims.

Although the invention is illustrated and described herein as embodied in a method and a device for releasing printing material from a cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
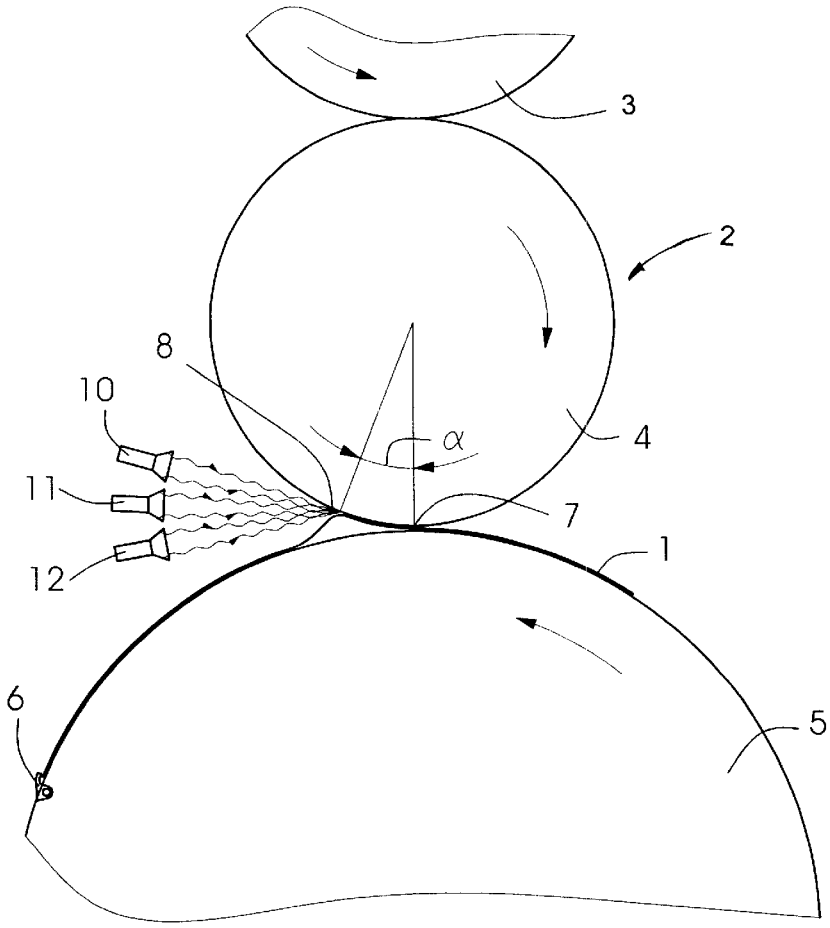
FIG. 1 is a fragmentary diagrammatic side elevational view of a device formed of a plurality of cooperating ultrasonic sources for releasing printing material from a cylinder along a tear line.

Referring now to the drawing and, first, particularly, to FIG. 1 thereof, there is shown fragmentarily therein, in a side elevational view, a section of a rotary printing machine for processing sheet material 1. The section of the printing machine that is shown is an offset printing unit 2 which includes a printing form cylinder 3, a rubber blanket cylinder 4, and an impression cylinder 5 having at least one gripper system 6 for holding the printing material 1.

The rubber blanket cylinder 4 is equipped with a rubber blanket that has good QR (Quick Release) characteristics; however, it is usually impossible to prevent the printing material 1 from remaining stuck completely to the rubber blanket cylinder 4 after the printing material 1 has passed through a printing nip 7 at the side that has been printed by the offset printing unit and from being picked up thereafter by the impression cylinder 5. The size of a tear angle $\alpha$ between the printing nip 7 and a tear line 8 of the printing material 1 depends upon the adhesiveness (tack or tackiness value) of the ink that is applied by the rubber blanket cylinder 4, the paper quality of the printing material 1, and the speed of the peripheral surface of the rubber blanket cylinder 4, which corresponds to the speed of the printing machine.

Figure 2:
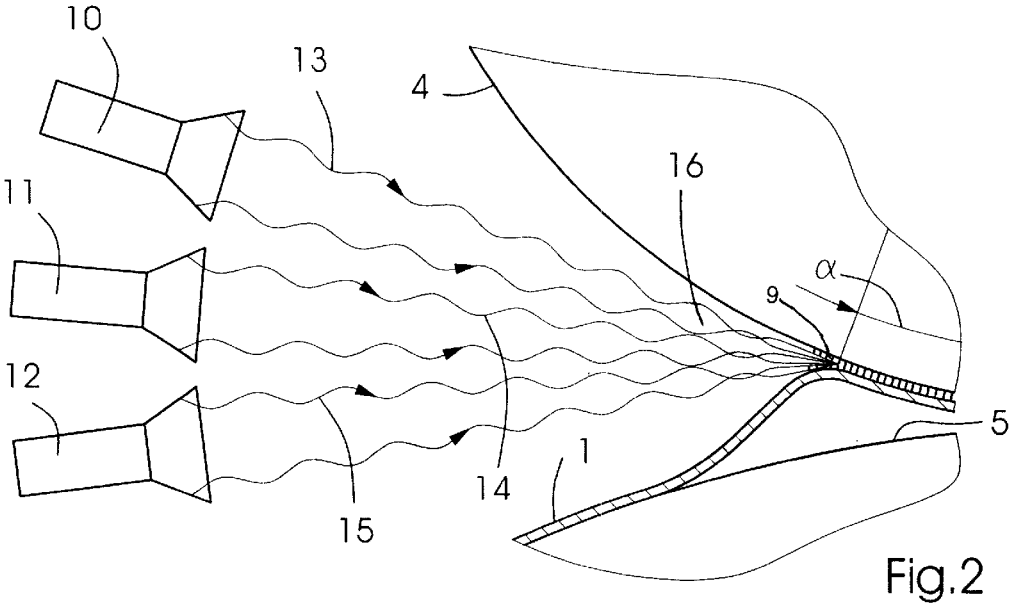
FIG. 2 is an enlarged fragmentary view of FIG. 1 showing the tear line in greater detail.

In the region of the tear line 8, the ink that is located between the printing material 1 and the rubber blanket cylinder 4 forms so-called tear threads 9 (note FIG. 2), which are purposefully severed by a plurality of piezoelectric ultrasonic sources 10, 11 and 12. Ultrasonic waves 13, 14 and 15 of the ultrasonic sources 10, 11 and 12, respectively, are focused on the tear threads 9, so that the ultrasonic waves 13, 14 and 15 which impinge on the tear threads 9 serve to reduce 90% or more of the tackiness of the ink locally in the tear threads 9, and consequently sever the tear threads 9 more easily.

Each of the ultrasonic sources 10, 11 and 12 is disposed, together with additional ultrasonic sources which are concealed thereby in FIG. 1, in a wedge-shaped space 16 located between the printing material 1 and the rubber blanket cylinder 4 in a row extending over the whole width of the printing material 1 axially parallel to the rubber blanket cylinder 4 and the tear line 8.

The invention is based upon the recognition that, in a labile system of complexly interrelated influences such as the characteristics of the rubber blanket and the printing material 1 as well as the speed of the printing machine, in which system, the slightest variations of parameters, such as the speed of the printing machine, can change the result considerably, a strong, defined additional influence must be introduced, which superimposes the labile system on smaller influences and, in this manner, stabilizes it. With this recognition in mind, the characteristics of the ultrasonic waves 13, 14 and 15 are exploited in that, in impinging upon the ink, they lower the adhesive power thereof to a value below 10% of the starting situation. Thus, a line of preliminary severing of the tear threads 9 is created directly behind or downline from the printing nip 7 by the purposeful and focused use of the ultrasonic waves 13, 14 and 15.

Should the ultrasonic waves 13, 14 and 15 not have been used, the tear angle $\alpha$ would grow with increasing speed of the printing machine and would shrink with diminishing speed of the printing machine. Due to the tearing of the tear threads 9, which is controlled by the ultrasonic waves 13, 14 and 15, the tear line 8 is stabilized, so that the predetermined tear angle $\alpha$ remains constant, assuming variations in the speed of the printing machine. Furthermore, the tear line 8 no longer wanders forward or backward along the circumferential line of the rubber blanket cylinder 4 if changes should occur in other parameters.

I claim:

1. A method for releasing printing material from a cylinder in a device for processing the printing material, which comprises directing ultrasonic waves into a wedge-shaped space located between the printing material and the cylinder.

2. The method according to claim 1, which includes directing the waves at tear threads adhering to the cylinder and the printing material.

3. The method according to claim 1, which includes focusing the waves.

4. The method according to claim 1, wherein the ultrasonic waves have a frequency of approximately 50 kilohertz.

5. A method for releasing printing material from a cylinder in a device for processing the printing material, which comprises directing electromagnetic waves into a wedge-shaped space located between the printing material and the cylinder.

6. The method according to claim 5, wherein the electromagnetic waves are microwaves.

7. The method according to claim 5, wherein the electromagnetic waves are light waves.

8. A device for releasing printing material from a cylinder in a device for processing the printing material, comprising at least one ultrasonic wave source directing waves into a wedge-shaped space located between the printing material and the cylinder.

9. The device according to claim 8, wherein said ultrasonic source has a piezo-electric construction.

10. The device according to claim 8, wherein said wave source is disposed near a printing nip defined by the cylinder.

11. The device according to claim 8, which includes a plurality of said wave sources directed at said focus.

12. The device according to claim 11, wherein said wave sources directed at said focus are angularly offset from one another in a vertical plane.

13. A device for releasing printing material from a cylinder in a device for processing the printing material, comprising at least one light source directing waves into a wedge-shaped space located between the printing material and the cylinder.

14. The device according to claim 13, wherein said light source is a halogen tube.

15. The device according to claim 13, wherein said light source is a heat emitter.

* * * * *